US005477708A

United States Patent [19]

Savkar et al.

[11] Patent Number: 5,477,708

[45] Date of Patent: Dec. 26, 1995

[54] VIBRATION-ISOLATED WASHING MACHINE AGITATOR

[75] Inventors: Sudhir D. Savkar, Niskayuna; Robert E. Sundell, Clifton Park, both of N.Y.

[73] Assignee: General Electric Company, Schenectady, N.Y.

[21] Appl. No.: 315,022

[22] Filed: Sep. 29, 1994

[51] Int. Cl.[6] ..... D06F 17/10

[52] U.S. Cl. ..... 68/134; 416/134 R

[58] Field of Search ..... 68/133, 134; 366/276, 366/278; 138/112, 114; 416/131, 134 R, 174

[56] References Cited

U.S. PATENT DOCUMENTS

| | | | |
|---|---|---|---|
| 2,078,139 | 4/1937 | Holm-Hansen | 68/133 |
| 2,161,604 | 6/1939 | Watts | 68/133 X |
| 2,306,234 | 12/1942 | Smith | 68/133 |
| 3,299,964 | 1/1967 | Foster | 416/134 R X |
| 3,701,611 | 10/1972 | Lambrecht | 416/134 R |

FOREIGN PATENT DOCUMENTS

| | | | |
|---|---|---|---|
| 664033 | 5/1963 | Canada | 416/134 R |

*Primary Examiner*—Philip R. Coe
*Attorney, Agent, or Firm*—Paul R. Webb, II

[57] ABSTRACT

An apparatus is provided which may be adapted for use as a washing machine agitator which isolates an agitator drive unit from the peak torques exerted upon vanes of the agitator due to irregularities in the rotational oscillation of the agitator which would result from a typical washing machine transmission apparatus. The apparatus isolates the peak torques by providing an inner and an outer agitator post wherein the inner post attaches to the drive unit and the outer post has integrally formed to it agitator vanes and an agitator skirt, the apparatus further provides a flexible connecting means attaching the inner post to the outer post such that the resonant frequency of the outer post, the agitator vanes and the agitator skirt taken as a unit will be close to that of the agitator stroke rate. The flexible connecting means comprises a plurality of webs extending continuously along all or portion of the posts in an axial direction such that the apparatus may be formed by a single-draw mold.

25 Claims, 5 Drawing Sheets

VIBRATION-ISOLATED WASHING MACHINE AGITATOR

BACKGROUND OF THE INVENTION

1. Field of the Invention

The instant invention relates generally to an apparatus for reducing the high dynamic torques required from the drive train to rotate an oscillating shaft, thereby reducing power consumption of the power supply unit and wear of the drive train. More specifically, the instant invention relates to a washing machine agitator which will reduce the dynamic torque required to produce its oscillating rotation.

It has been discovered that for a given stroke rate of a washing machine agitator, a sinusoidal agitator motion, as graphically viewed with respect to time, requires the lowest peak torque and drive power. Conventional transmissions used in washing machines do not, however, produce such wave forms. Instead, higher harmonics are produced at the end of each agitator stroke and require large torques from the power unit as well as the drive train.

The instant invention provides an agitator comprising a post and integral vanes which have a lower torsional resonant frequency than that of the agitator stroke rate. This results in lower torque requirements by isolating the transmission and the drive motor FROM THE HIGHER HARMONICS associated with the conventional washing machine transmissions.

2. Description of the Related Art

Previous attempts to isolate the higher harmonics associated with the conventional washing machine transmissions have complicated the manufacture of the agitator. FIG. 1 depicts the previous attempt at an agitator which would isolate higher harmonics. Agitator 10 comprises a single agitator post 12 connected to each agitator vane 14 only one of which is shown for sake of simplicity. The agitator post 12 and each vane 14 are each connected to skirt 16.

To lower the peak torque required by the agitator, each vane was undercut at its connection to the skirt 16 along a majority of that connection. This undercut 18 allowed each vane 14 the flexibility needed to isolate the drive transmission not depicted from the high harmonics typically associated with washing machine transmissions.

Problems arise, however, in producing the agitator 10 in an efficient and cost effective manner. The molding of undercut 18 prohibits the production of agitator 10 by a single-draw mold as is well known in the art. One of ordinary skill in the art of molding would recognize that the portion of the mold not depicted which would create a void of material to produce undercut 18 would prevent that: mold from simply withdrawing from the molded agitator 10. Agitator 10 therefore requires a multiple step molding process which significantly increases production costs.

Further problems arise in the application of agitator 10. Undercut 18 will, at times, capture an article of clothing between the vane and skirt. This may prevent the flex of the vane needed to lower the peak torque required and may further cause excess wear on the article captured. Lastly, items caught in undercut 18 may result in breaking or removal of buttons or other attachments to articles washed.

The principle object of the instant invention is therefore to provide a means to isolate a shaft which oscillates in an axially rotating manner from peak torques wherein said means can be fabricated by a single-draw mold.

It is a further object of the instant invention to produce the isolated shaft means in the form of an agitator for a washing machine.

It is a further object of the instant invention to reduce the power required to drive a washing machine agitator.

It is a further object of the instant invention to reduce the peak torque imparted to the drive shaft and the peak forces sustained by the transmission of the washing machine.

SUMMARY OF THE INVENTION

The above and other objects of the instant invention are accomplished by providing an improved and more cost efficient means for isolating the high harmonics created by the typical washing machine transmission. This is accomplished by the preferred embodiment of the present invention which disposes a flexible connector means between an inner agitator post and an outer co-annular agitator post which is integral to the agitator vanes wherein the connector means allows said outer post and integral vanes to have a low torsional resonant frequency which is lower than the frequency of the agitator's stroke rate. Isolating the high harmonics which cause the peak torques in this manner eliminates the need to undercut the vanes and the problems associated with said undercuts.

By constructing the flexible connector means continuously along all or portion of the posts, the instant agitator may be produced by a single-draw mold. Further, by removing the undercut between the vanes and the skirt, the instant agitator creates no risk of excess wear or destruction of attachments to any article washed.

The flexible connector means is accomplished by a plurality of web means, each contiguous with both the inner agitator post and the outer co-annular agitator post over a height of the posts dictated by detailed design considerations including the natural frequency sought. The degree of vibration isolation caused by the connecting means may be varied by the number of webs as well as the thickness, shape and material thereof.

In an alternate embodiment, the tips of the vanes may also be extended beyond the outer edge of the skirt in a substantially radial direction to further alter the resonant frequency of the outer post and integral vanes.

DETAILED DESCRIPTION OF THE PREFERRED EMBODIMENT

Figure 1:
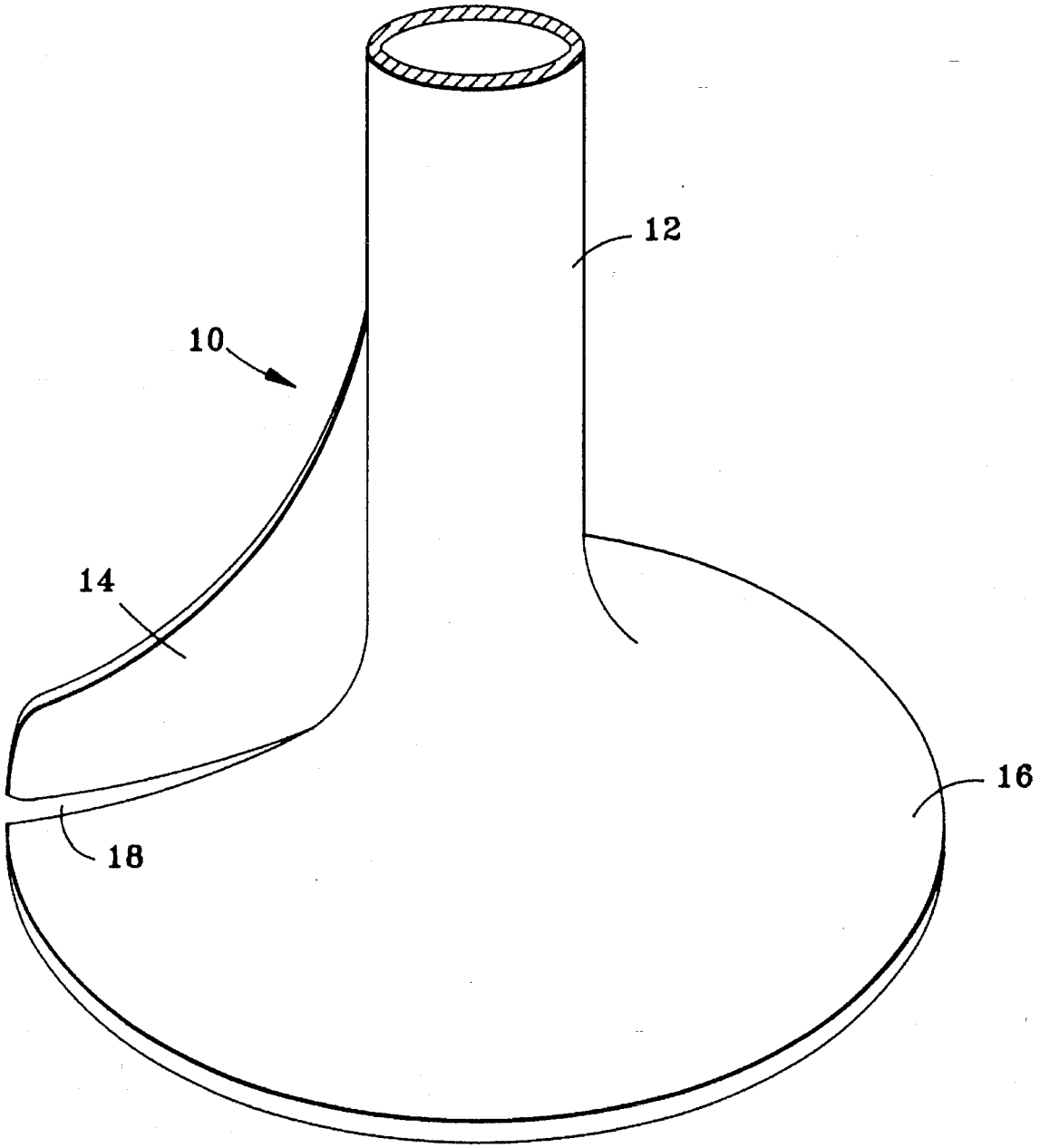
FIG. 1 PRIOR ART
FIG. 1 is a substantially schematic view of an apparatus known in the art for agitation of clothing in a washing machine.
Figure 2A:
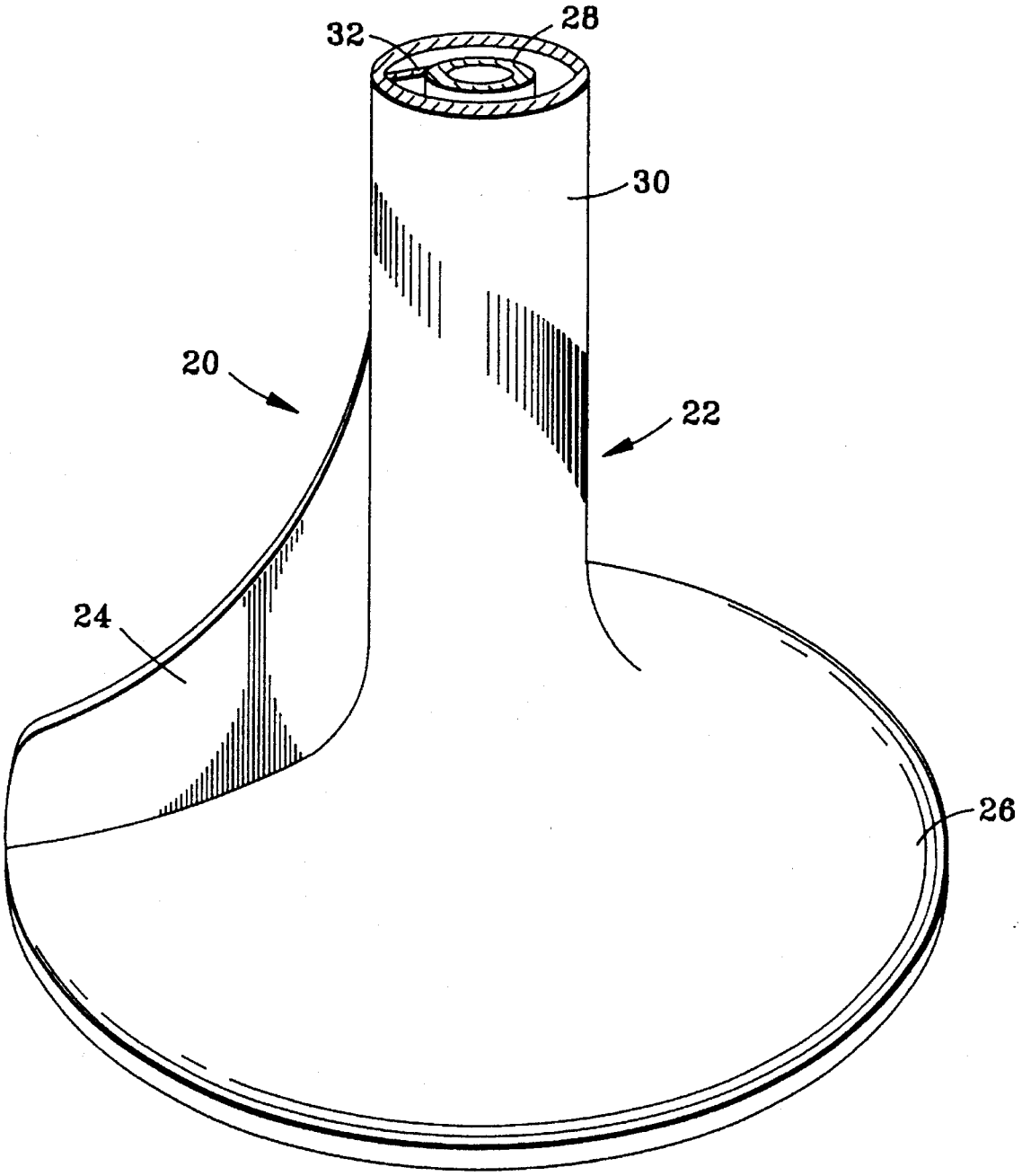
FIG. 2*a* is a substantially schematic view of a preferred embodiment of the instant invention.

The present invention is accomplished in a preferred embodiment by the agitator 20 of FIG. 2*a*. In that embodiment the agitator 20 comprises an agitator post 22 integral with a set of vanes 24 and a skirt 26. Unlike the agitator of FIG. 1, a lower end of each of the vanes 24 of the instant agitator 20 are contiguous with skirt 26. Agitator post 22 comprises an inner post 28 and an outer co-annular post 30 running concentric to said inner post 28. The inner and outer posts are connected by a connecting means 32 comprising a plurality of webs 34 (see FIG. 2*b*) running contiguous to each of the inner- and outer posts in an axial direction. Inner post 28 has a plurality of splines 36 on its inner diameter for mounting to a drive shaft (not shown) which will dictate its movement. Other means of connecting inner post 28 to a drive shaft will be readily apparent to those skilled in the art. Vanes 24, only one of which is shown for sake of simplicity, are mounted on the outer diameter of outer post 30 and attach along the axial length of agitator post 22. The lower end of vanes 24 connect directly to and run outward on skirt 26 in a radial direction which is attached to the lower end of agitator post 22. The undercut 18 as shown in FIG. 1 has been eliminated overcoming the problems discussed above. The numerous variations available to the shape and size of vanes 24 and the skirt 26 will be recognized by one skilled in the art. The instant invention contemplates all possible variations made to the thickness, height, curvature or variation in outward extension of the vanes 24 and all possible variations to the diameter, height or curvature of skirt 26.

The inventive concept of the instant invention is that by placing flexible connecting means 32 between inner post 28 and outer co-annular post 30, the characteristics of the flexible connecting means 32 may be chosen to accommodate the desired material of agitator 20 and the desired characteristics of the outer post 30, the vanes 24 and skirt 26. The outer post 30, the vanes 24 and skirt 26 comprise an outer agitator assembly. In accommodating those characteristics the connecting means 32 give the outer agitator assembly a low torsional resonant frequency lower than or close to that of the desired agitator stroke rate at which the host machine for washing articles oscillates it. This accommodation isolates the higher harmonic and torque requirements associated with a typical clothes washing machine transmission. Although vibration isolation is a well known art, the apparatus of the instant invention achieves vibration isolation in a novel manner.

Figure 2B:
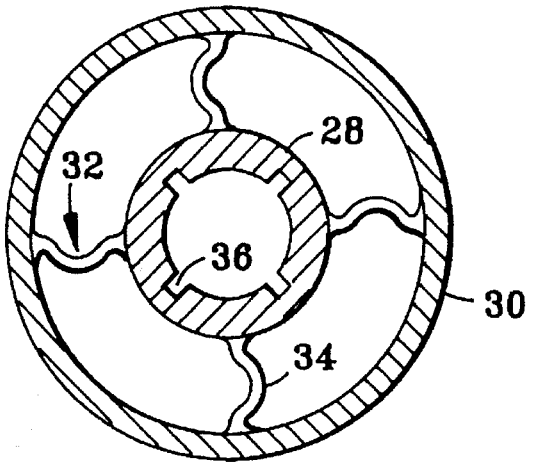
FIG. 2*b* is a substantially schematic cross-sectional view of the agitator post employing a connecting means comprising webs of elongated substantially U-shaped cross-section.

FIG. 2*b* shows in a substantially schematic cross-sectional view the instant agitator post 22 employing a preferred embodiment connecting means 32. It will become apparent to one skill in the art that by varying connecting means 32 as described below, the benefit afforded by the instant invention may be imparted upon any agitator regardless of the characteristics of the outer agitator assembly. Connecting means 32 comprises a plurality of webs 34 with an elongated U-shaped cross-section. The number of webs 32 employed, thickness of each web 32 and shape of each web 34 to be used for a specific application could be varied using routine experimentation to accommodate the material from which agitator 20 is to be constructed and the physical characteristics of the outer agitator assembly. Each U-shaped web 34 of connecting means 32 runs contiguous with the inner post 28 and the outer post 30 for the substantial length of agitator post 22. Although a straight web could be made to operate properly, the preferred embodiment of each U-shaped web 34 comprises a wavy cross-section to reduce its stiffness and increase its life. A straight web would be placed under comparatively greater shear stress in any given application when compared to a wavy formed web and would fail in a shorter period of use. A plurality of splines 36 are shown on the inner diameter of inner post 28 for mounting to a drive shaft (not shown).

Figure 2C:
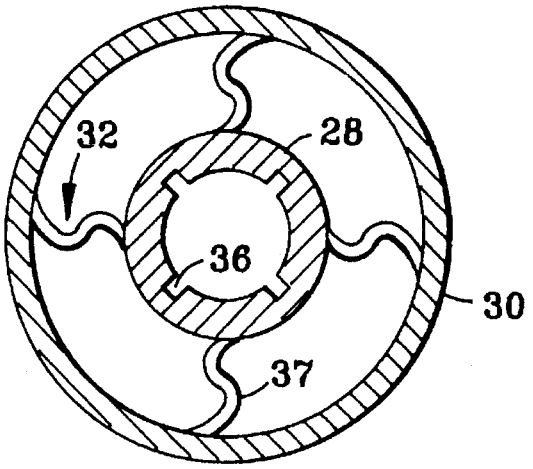
FIG. 2*c* is a substantially schematic cross-sectional view of the agitator post employing a connecting means comprising webs of substantially S-shaped cross-section.
Figure 2D:
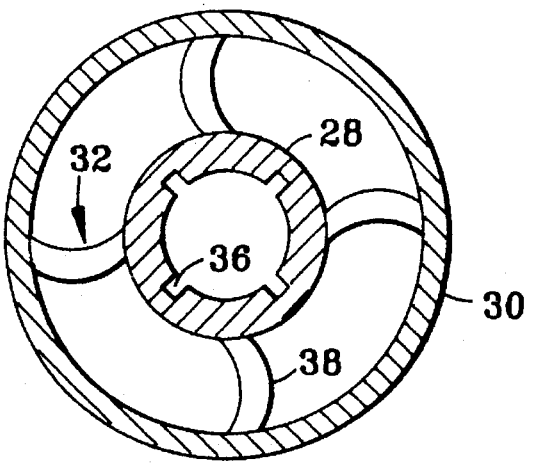
FIG. 2*d* is a substantially schematic cross-sectional view of the agitator post employing a connecting means comprising webs of substantially C-shaped cross-section.

FIG. 2*c* shows the connecting means 32 comprising a plurality of webs 37 with a S-shaped cross-section. FIG. 2*d* shows the connecting means 32 comprising a plurality of webs 38 with a C-shaped cross-section. It should be readily apparent to those skilled in the art that many other cross-sections would also accomplish the advantage of a wavy formed web.

Figure 3A:
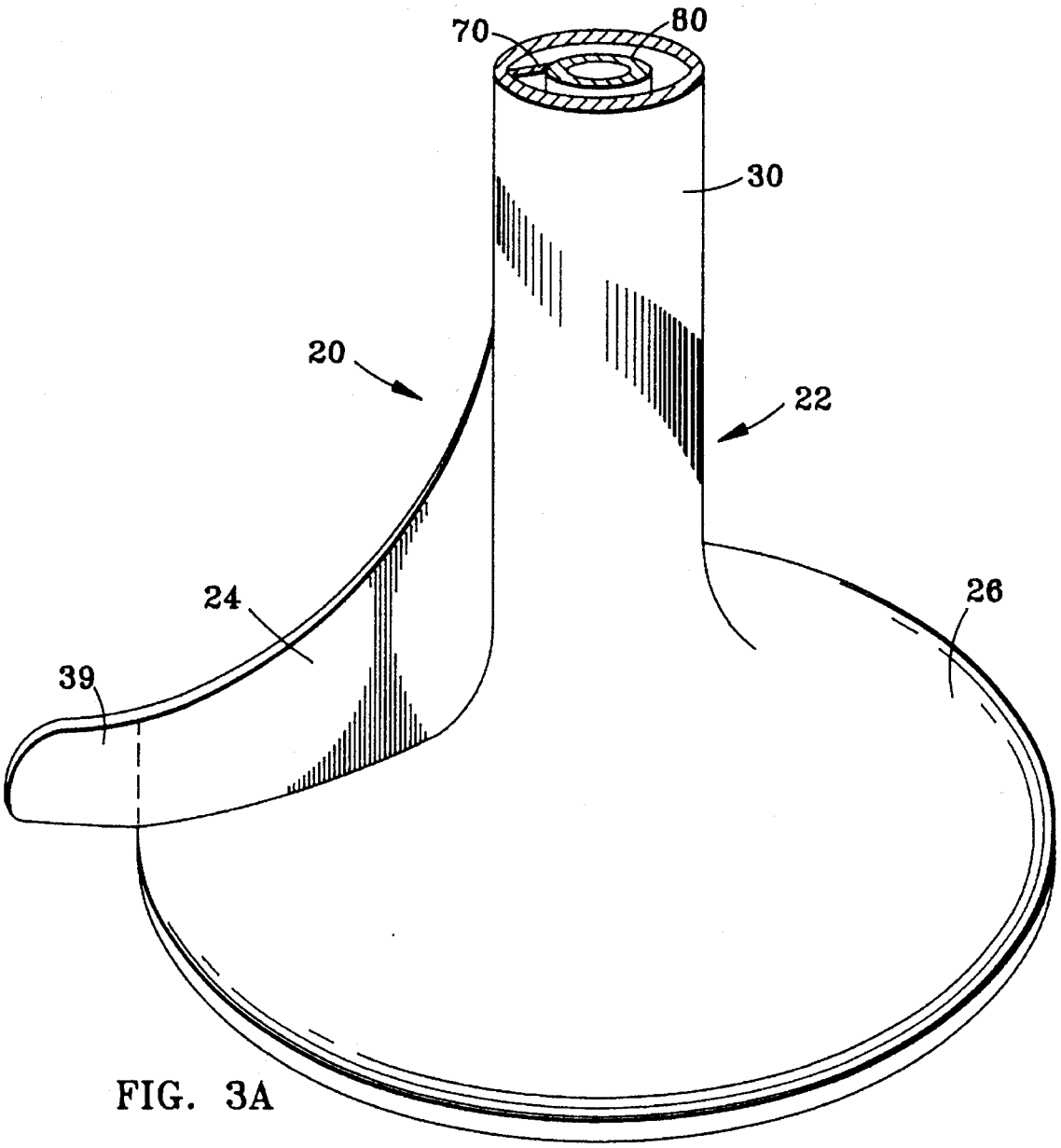
FIG. 3*a* is a substantially schematic view of an embodiment allowing additional modification of the resonant frequency of the agitator.

Referring to FIG. 3*a*, it may occasionally be desirable to increase the flexibility of the agitator post 22 beyond what may be accomplished by the flexibility of the connecting means 32. In such an instance each vane 24 may be extended beyond the outer edge of skirt 26 leaving a vane tip 39 where they would be able to flex during the oscillating rotation of agitator 20. The use of such tips 39 would further alter the resonant frequency of the outer agitator assembly. It is anticipated that one of ordinary skill in the art could employ various shapes and sizes of vane tips 39, as needed, to obtain a desired resonant frequency of the outer agitator assembly through routine experimentation.

Vane flexure is obtained by vane tips 39 rather than undercuts 18 (FIG. 1) allows an agitator 20 to be produced by a single-draw mold. As discussed supra, the mold used to produce agitator 10 requires a portion positioned under vane 14 to create a void of agitator material which becomes undercut 18 in the completed product. That portion of the mold positioned under vane 14 would prevent the removal of the mold in an axial direction and thereby eliminate a single-draw mold as a viable production method for agitator 10. By eliminating undercut 18, the mold used to produce agitator 20 has no portion which will obstruct removal in an axial direction. The use of the single-draw molding method is therefore viable.

Figure 3B:
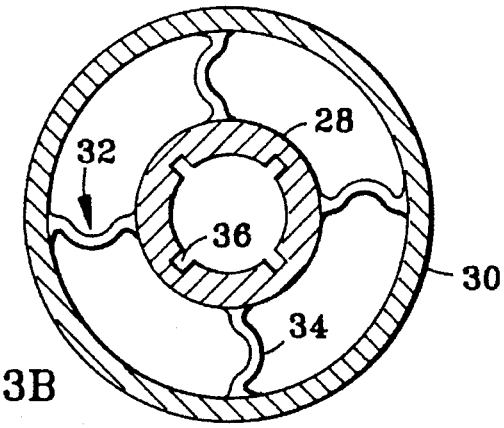
FIG. 3*b* is a substantially schematic cross-sectional view of the agitator post employing a connecting means comprising webs of elongated substantially U-shaped cross-section.

FIG. 3*b* shows the instant agitator post 30 employing a preferred embodiment connecting means 32. Connecting means 32 comprises a plurality of webs 34 with an elongated U-shaped cross-section. The number of webs 34 employed, thickness of each web 34 and shaped of each web 34 to be used for a specific application could be varied using routing experimentation to accommodate the material from which agitator 20 is to be constructed and the physical characteristics of the outer agitator assembly. Each U-shaped web 34 of connecting means 32 runs contiguous with the inner post 28 and the outer post 30 for the substantial length of agitator post 22. Although a straight web could be made to operate properly, the preferred embodiment of each U-shaped web 34 comprises a wavy cross-section to reduce its stiffness and increase its life.

Figure 4:
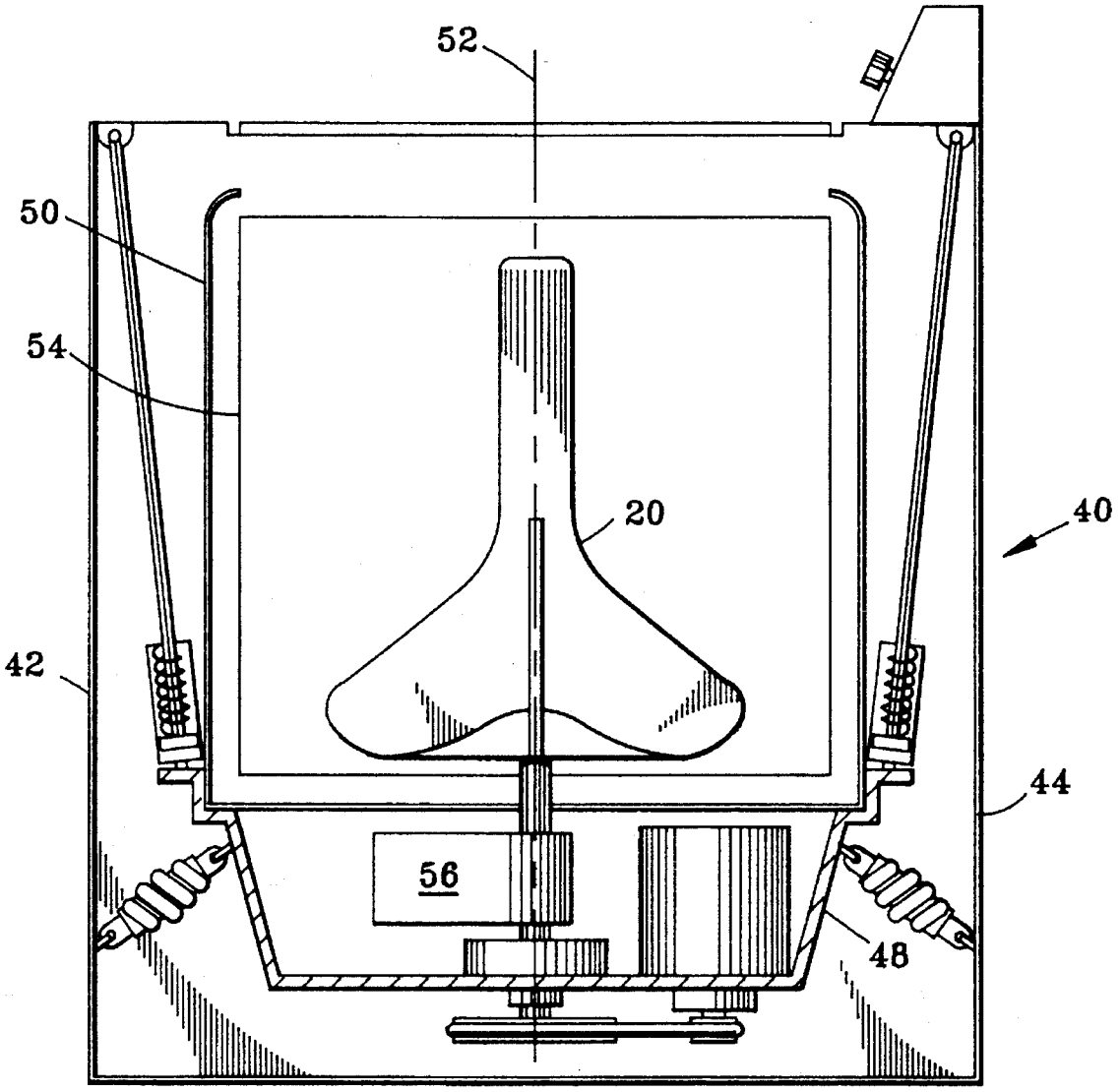
FIG. 4 is a substantially schematic view of a typical clothes washing machine which would employ the agitator of the instant invention.

FIG. 4 depicts a typical clothes washing machine which would employ the agitator of the instant invention. The machine comprises housing 40 having a front panel 42, rear panel 44, side panels, a mounting platform 48 within housing 40, a tub 50 having a vertical axis 52 wherein tub 50 is mounted on mounting platform 48 within the housing 40 and at a position spaced from each of said housing panels. The machine further comprises a basket 54 in tub 50 being of sufficient size for holding articles to be washed, means 56 for imparting oscillating motion to an agitator and a vibration-isolated agitator 20 of the instant invention.

Because of the many agitator characteristics of the instant invention which may be varied as described supra, it is recognized that the entire agitator 20, may be fabricated from a single material. Although one skilled in the art could vary the material of the webs 32 or tips 38 from that of the rest of the agitator 20 the cost of fabrication would be dramatically increased. The preferred embodiment would consequently comprise the entire agitator 20 of a typical agitator material such as polypropylene or any suitable substitute therefor.

It is to be recognized that the foregoing detailed description of the preferred embodiment of the instant invention is given merely by way of illustration, and that numerous modifications and variations may become apparent to those skilled in the art without departing from the spirit and scope of the invention. Therefore, the scope of the present invention is to be determined by reference to the appended claims.

We claim:

1. An apparatus comprising:

an inner shaft having an inner surface and an outer surface;

an outer co-annular shaft having an inner surface and an outer surface, and a base end;

a plurality of flexible webs disposed between and extending contiguous with each of the outer surface of the inner shaft and the inner surface of the outer shaft for flexibly attaching said inner shaft to said outer shaft for minimizing peak torque transmission from said outer shaft to said inner shaft a set of vanes fixedly attached to said outer surface of said outer shaft; and a skirt integrally formed with the outer co-annular shaft at said base end wherein said skirt has an outer diameter and said vanes extend contiguously along the skirt.

2. The apparatus of claim 1 wherein said inner shaft and said outer shaft are each integral with said webs.

3. The apparatus of claim 1 wherein said webs extend contiguous with the outer surface of the inner shaft and the inner surface of the outer shaft in an axial direction of said shafts and said webs having a substantially elongated U-shaped cross-section.

4. The apparatus of claim 1 wherein said said webs extent partially contiguous with the outer surface of the inner shaft and the inner surface of the outer shaft in an axial direction of said shafts and said webs having a substantially elongated U-shaped cross-section.

5. The apparatus of claim 1 wherein said webs extend contiguous with the outer surface of the inner shaft and the inner surface of the outer shaft in an axial direction of said shafts and said webs having a substantially S-shaped cross-section.

6. The apparatus of claim 1 wherein said webs extend partially contiguous with the outer surface of the inner shaft and the inner surface of the outer shaft in an axial direction of said shafts and said webs having a substantially elongated S-shaped cross-section.

7. The apparatus of claim 1 wherein said webs extend contiguous with the outer surface of the inner shaft and the inner surface of the outer shaft in an axial direction of said shafts and said webs having a substantially C-shaped cross-section.

8. The apparatus of claim 1 wherein said webs extend partially contiguous with the outer surface of the inner shaft and the inner surface of the outer shaft in an axial direction of said shafts and said webs having a substantially elongated C-shaped cross-section.

9. The apparatus of claim 1 wherein the apparatus is integrally molded of polypropylene.

10. The apparatus of claim 9 wherein the apparatus is a single-draw molded plastic component.

11. An agitator apparatus for a machine for washing articles wherein said agitator apparatus comprises:

an inner post having an inner surface for connecting to a drive of a washing machine transmission and said inner post further having an outer surface;

an outer co-annular post having an inner surface and an outer surface, and a base end;

a plurality of flexible webs disposed between and extending contiguous with each of the outer surface of the inner post and the inner surface of the outer post for flexibly attaching said inner post to said outer post for minimizing peak torque transmission from said outer post to said inner post during rotational oscillation of the apparatus effected by said transmission;

a set of vanes fixedly attached to said outer surface of said outer post; and a skirt integrally formed with the co-annular outer post at said base end wherein said skirt has an outer diameter and said vanes extend contiguously along the skirt.

12. The apparatus of claim 11 wherein said inner post and said outer post are each integral with said connecting means.

13. The apparatus of claim 12 wherein said webs extend partially contiguous with each of the outer surface of the inner post and the inner surface of the outer post.

14. The apparatus of claim 12 wherein said webs extend contiguous with the outer surface of the inner post and the inner surface of the outer post in an axial direction of said shafts and said webs having a substantially elongated U-shaped cross-section.

15. The apparatus of claim 13 wherein said webs extend partially contiguous with the outer surface of the inner post and the inner surface of the outer post in an axial direction of said shafts and said webs having a substantially elongated U-shaped cross-section.

16. The apparatus of claim 13 wherein said webs extend contiguous with the outer surface of the inner post and the inner surface of the outer post in an axial direction of said shafts and said webs having a substantially S-shaped cross-section.

17. The apparatus of claim 12 wherein said webs extend partially contiguous with the outer surface of the inner post and the inner surface of the outer post in an axial direction of said shafts and said webs having a substantially S-shaped cross-section.

18. The apparatus of claim 12 wherein said webs extend contiguous with the outer surface of the inner post and the inner surface of the outer post in an axial direction of said shafts and said webs having a substantially C-shaped cross-section.

19. The apparatus of claim 12 wherein said webs extend partially contiguous with the outer surface of the inner post and the inner surface of the outer post in an axial direction of said shafts and said webs having a substantially C-shaped cross-section.

20. The apparatus of claim 1 wherein the apparatus is integrally molded of polypropylene.

21. The apparatus of claim 20 wherein the apparatus is a single-draw molded plastic component.

22. An apparatus comprising:

an inner shaft having an inner surface and an outer surface;

an outer co-annular shaft having an inner surface and an outer surface;

a set of vanes fixedly attached to said outer surface of said outer shaft;

a plurality of flexible webs disposed between and extending contiguous with each of the outer surface of the inner shaft and the inner surface of the outer shaft for flexibly attaching said inner shaft to said outer shaft for minimizing peak torque transmission from said outer shaft to said inner shaft; and a skirt integrally formed with the outer co-annular shaft wherein said skirt has an outer diameter and said vanes extend contiguously along the skirt to the outer diameter of the skirt such that the vanes extend outward in a substantially radial direction beyond the outer diameter of said skirt to define vane tips, and wherein each tip is flexible for further minimizing peak torque transmission from said outer shaft to said inner shaft.

23. An agitator apparatus for a machine for washing articles wherein said agitator apparatus comprises:

an inner post having an inner surface for connecting to a drive of a washing machine transmission and said inner post further having an outer surface;

an outer co-annular post, having an inner surface and an outer surface;

a plurality of flexible webs disposed between and extending contiguous with each of the outer surface of the inner post and the inner surface of the outer post for flexibly attaching said inner post to said outer post for minimizing peak torque transmission from said outer post to said inner post;

a set of vanes fixedly attached to said outer surface of said outer post; and a skirt integrally formed with the co-annular outer post wherein said skirt has an outer diameter and said vanes extend contiguously along the skirt and beyond the outer diameter of the skirt such that said vanes extend outward in a substantially radial direction beyond said skirt to define vane tips, and wherein each tip is flexible for further minimizing peak torque transmission from said outer post to said inner post.

24. A machine for washing articles, comprising:

a housing having a front panel, rear panel, left panel, and right panel, a mounting platform within said housing, a tub having a vertical axis and being mounted on said platform within said housing at a position spaced from each of said housing panels, a basket in said tub having a size sufficient for holding articles to be washed, an agitator within said basket whose oscillating motion facilitates washing of said articles, means for imparting oscillating motion to said agitator during a wash cycle, and said agitator comprising:

an inner post having an inner surface connecting to said means for imparting oscillating motion and having an outer surface, an outer co-annular post having an inner surface and an outer surface, a set of vanes fixedly joined to said outer surface of said outer post, and a plurality of flexible webs disposed between and extending contiguous with each of the outer surface of the inner post and the inner surface of the outer post for flexibly attaching said inner post to said outer post for minimizing peak torque transmission from said outer post to said inner post during rotational oscillation of the agitator.

25. A washing machine according to claim 24 wherein:

said agitator outer post with said vanes and skirt attached thereto has a torsional resonant frequency;

said oscillating means is effective to generate an agitator stroke rate during said wash cycle; and said torsional resonant frequency is less than about said agitator stroke rate.

* * * * *